US005108297A

United States Patent [19]

Hoffman et al.

[11] Patent Number: 5,108,297

[45] Date of Patent: Apr. 28, 1992

[54] POSITIVE LOCKING ELECTRICAL PLUG WITH SHIELDED BLADE PROTECTION

[75] Inventors: Ernest G. Hoffman, Middlefield; David H. Romatzick, Jr., Milford, both of Conn.

[73] Assignee: Hubbell Incorporated, Orange, Conn.

[21] Appl. No.: 618,302

[22] Filed: Nov. 26, 1990

[51] Int. Cl.[5] ..... H01R 13/625

[52] U.S. Cl. ..... 439/134; 439/141; 439/304; 439/333

[58] Field of Search ..... 439/140, 141, 318, 332–337, 439/324, 133, 134, 304

[56] References Cited

U.S. PATENT DOCUMENTS

| | | | |
|---|---|---|---|
| 2,396,901 | 3/1946 | Tiffany | 439/140 |
| 2,423,250 | 7/1947 | Modrey | 439/324 |
| 2,684,860 | 7/1954 | Rafferty | 285/85 |
| 2,750,571 | 6/1956 | Schmier | 439/472 |
| 2,844,805 | 7/1958 | Darrell | 439/134 |
| 3,120,987 | 2/1964 | Degnan et al. | 439/588 |
| 3,390,404 | 6/1968 | Murchison | 439/589 |
| 3,393,395 | 7/1968 | Hubbell | 439/333 |
| 3,500,291 | 3/1970 | Hubbell et al. | 439/337 |
| 3,739,321 | 6/1973 | Murphy et al. | 439/589 |
| 3,754,205 | 8/1973 | Lenkey | 439/141 |
| 3,790,914 | 2/1974 | Hough | 439/102 |
| 3,888,559 | 6/1975 | Geib | 439/258 |
| 3,890,025 | 6/1975 | Gray | 439/102 |
| 3,950,059 | 4/1976 | Anhalt et al. | 439/261 |
| 4,241,969 | 12/1980 | D'Amato et al. | 439/318 |
| 4,340,267 | 7/1982 | Nukaga | 439/141 |
| 4,354,723 | 10/1982 | Lee | 439/462 |
| 4,445,739 | 5/1984 | Wooten | 439/140 |
| 4,820,176 | 4/1989 | Niikura | 439/152 |
| 4,832,613 | 5/1989 | Tsukakoshi | 439/141 |

FOREIGN PATENT DOCUMENTS

| | | |
|---|---|---|
| 486174 | 11/1953 | Italy . |
| 500653 | 2/1939 | United Kingdom . |

*Primary Examiner*—Neil Abrams

*Attorney, Agent, or Firm*—Jerry M. Presson; Alfred N. Goodman

[57] ABSTRACT

A male electrical connector with positive locking prongs and shielded blade protection. The connector comprises a plug body, a plurality of curved blades extending therefrom, and a plate carrying locking prongs and axially slidably coupled to the blades and plug body. In one embodiment, the plate is slidably received in a recess in the plug body, while in another embodiment, the plate is coupled to a tube which is slidably received on the exterior surface of the plug body. The connector can include an auxiliary lock-in assembly, a lock-out assembly, or both, as well as a seal to resist ingress of dirt or moisture.

36 Claims, 6 Drawing Sheets

POSITIVE LOCKING ELECTRICAL PLUG WITH SHIELDED BLADE PROTECTION

FIELD OF THE INVENTION

The invention relates to electrical connectors, and more particularly to male electrical connectors having a plurality of blades and a mechanism for positively locking the male connector to a female receptacle to avoid inadvertent disconnection therebetween. The connector also has a shield for the blades, as well as an auxiliary lock-in mechanism and a lock-out mechanism.

BACKGROUND OF THE INVENTION

Electrical connector assemblies of the locking type are well-known in the connector industry. Normally, the female portion of such a connector assembly has two or more arcuate, circularly arranged slots, and the male portion has an equal number of arcuate blades, the blades being dimensioned and arranged so that they can be inserted in the slots by a simple axial movement, and then, via rotation of one or both of the connector portions, the blades can be moved into a position from which they cannot be separated by simple axial movement. To accomplish this, one or more of the blades usually has an L-shaped configuration in which the laterally extending portion, or flag, of the blade engages a recess or shelf within the slot as a result of the rotation.

The male and female portions can take various configurations, but the male portion is usually a plug connected to the end of a multi-conductor cable. The female portion may also terminate a similar cable, or it can be a fixture or receptacle mounted in a partition or on a piece of equipment. In any event, it is possible for the cable attached to the male portion to be subjected to various forces which might tend to rotate the cable and also the male connector portion in the unlocking direction, thereby causing inadvertent unlocking and extraction of the blades from the slots.

To prevent this kind of undesired extraction, there has been an effort to develop connectors which have greater resistance to accidental disconnection or which have locking devices capable of precluding such accidental disconnection. However, many of these prior art devices are complicated to manufacture, assemble and use, and many of them require a significant number of parts and a specially designed female device to cooperate with the male device.

In addition, many of these electrical connector assemblies have some sort of shield which temporarily covers the blades during shipping or handling to protect the blades against distortion and to protect the installer from contacting the blades during installation. However, once again, many of these devices are unduly complicated to manufacture, assemble and use, and require numerous parts.

Moreover, there has recently been enacted by the Occupational Safety and Health Administration (OSHA) various regulations requiring specific mechanisms for preventing inadvertent connection of electrical connectors. These regulations require some sort of mechanism for locking out the electrical connector to avoid its inadvertent connection while, for example, the electrical device is being worked on.

Examples of various locking connectors are disclosed in the following U.S. Pat Nos.: 2,684,860 to Rafferty; 2,750,571 to Schmier; 3,120,987 to Degnan et al.; 3,390,404 to Murchison; 3,393,395 to Hubbell; 3,500,291 to Hubbell et al; 3,739,321 to Murphy et al; 3,790,914 to Hough; 3,888,559 to Geib; 3,890,025 to Gray; 3,950,059 to Anhalt et al; and 4,241,969 to D'Amato et al. Similar devices are disclosed in Italian patent 486174 and U.K. patent 500653.

In addition, examples of prior devices providing shields for the blades of electrical connectors are disclosed in the following U.S. Pat. Nos.: 2,396,901 to Tiffany; 2,423,250 to Modrey; 3,754,205 to Lenkey; 4,340,267 to Nukaga; 4,445,739 to Wooten; and 4,820,176 to Niikura.

SUMMARY OF THE INVENTION

Accordingly, a primary object of the invention is to provide a male electrical connector with an axially released positive locking feature and with shielded blade protection.

Another object of the invention is to provide a male electrical connector with the ability to lock out and lock in the connector relative to a female receptacle.

Another object of the invention is to provide a male electrical connector that is relatively simple to manufacture, assemble and use, and that has a relatively few number of parts.

Another object of the invention is to provide a male electrical connector that can be provided with a shield with or without a locking mechanism and also a locking mechanism with or without a shield.

A further object of the invention is to provide a male electrical connector with a biased shield which ejects the connector from the female device under conditions of inadequate blade engagement, and with a seal to resist invasion of dirt and moisture into the connector.

The foregoing objects are basically attained by providing a male electrical connector, the combination comprising an insulating plug body adapted to receive an electrical cable, and having a plurality of conductive blades extending therefrom, the blades being shaped and dimensioned for insertion into and translation in slots formed in a mating female connector as the plug body is moved axially and angularly, respectively, relative to the female connector; a plate having a plurality of openings, each of the openings slidably receiving one of the blades therein; a mechanism, coupled to the plate and plug body, for slidably coupling the plate and the plug body between first and second positions; and a locking assembly, coupled to and extending from the plate and receivable in at least one of the slots in the female connector once the blades are inserted into and translated in the slots, for resisting relative angular translation of the plug body and the female connector.

The foregoing objects are also attained by providing a male electrical connector, the combination comprising an insulating plug body adapted to receive an electrical cable, having an exterior surface, and having a plurality of conductive blades extending therefrom; a shield comprising a tubular wall having first and second ends, and a plate rigidly coupled to the tubular wall at the second end, the plate having a plurality of openings, each opening slidably receiving one of the blades therein, the plug body being received in the first end; an assembly, coupled to the shield and the plug body, for slidably coupling the shield and the plug body between first and second positions; and a biasing assembly, coupled to the shield and the plug body, for biasing the plate away from the plug body into the first position in which the plate is spaced from the plug body, the shield tubular wall slidably engaging the plug body exterior surface.

Other objects, advantages and salient features of the invention will become apparent from the following detailed description, which, taken in conjunction with the annexed drawings, discloses preferred embodiments of the invention.

DRAWINGS

Referring now to the drawings which form a part of this original disclosure:

Figure 24:
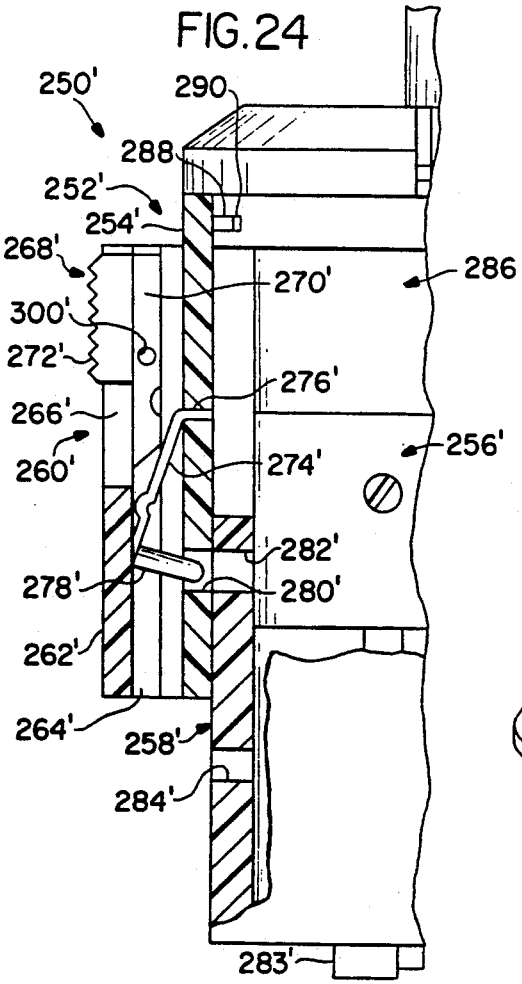
Figure 25:
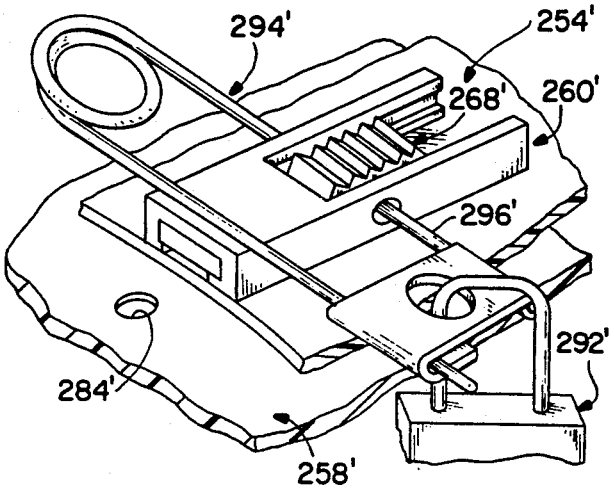

FIG. 24 is a fragmentary, side elevational view in partial section of a further modified embodiment of the invention in which a combined lock-out and lock-in slide assembly is coupled to the connector's cover, and the shield is slidably received inside the cover and has openings for receiving a pin in the slide assembly; and FIG. 25 is an enlarged, fragmentary left perspective view of the slide assembly shown in FIG. 24 with the addition of a padlock thereto.

DETAILED DESCRIPTION OF THE INVENTION

Referring to FIGS. 1–8, the male electrical connector 10, in accordance with the invention, is intended to be electrically connected and locked to the female electrical receptacle or connector 12 shown in FIGS. 2–4 and 8.

The male connector 10 comprises an insulating plug body 14, three conductive blades 16–18 extending downwardly therefrom, and a cup-shaped shield 20 slidably coupled to the plug body. A cable clamping assembly comprising first and second clamps 22 and 23 and mounting screws 25 and 26 are coupled to the plug body and receive the electrical cable 28 therein.

As seen best in FIG. 5, the electrical cable 28 is preferably a multi-conductor cable comprising three insulated conductors 30–32 with exposed ends for electrical connection with the plug body 14 as described below.

Figure 1:
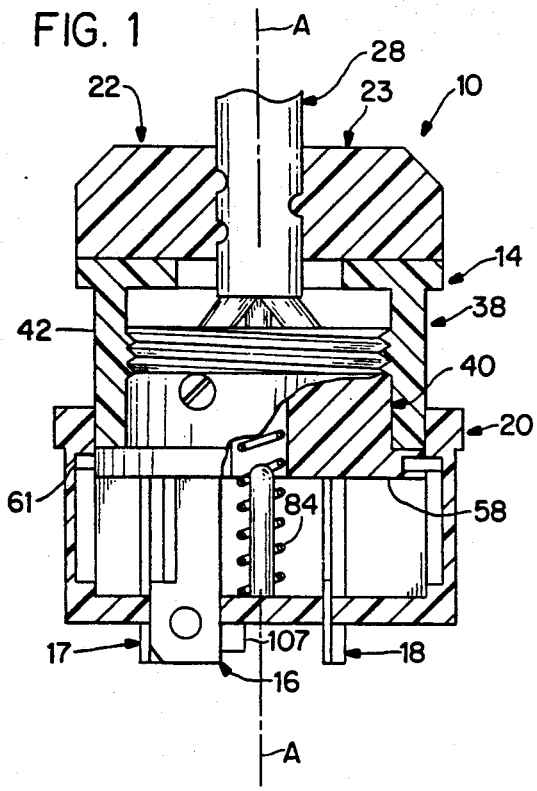
FIG. 1 is a side elevational view in substantially longitudinal section of the male electrical connector in accordance with the present invention in its first or rest position.

The first and second clamps 22 and 23 are substantially conventional and are received on the top of the plug body as seen in FIG. 1 and are coupled together via the mounting screws 25 and 26 which pass through suitable bores in clamp 23 and are received in suitable threaded bores in clamp 22 as indicated in FIGS. 2–5.

Figure 2:
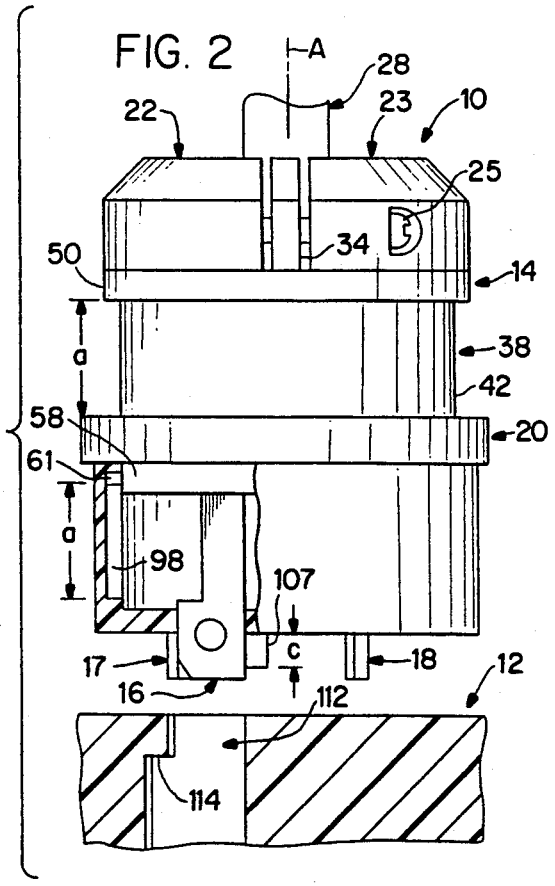
FIG. 2 is a side elevational view of the male electrical connector as shown in FIG. 1 with parts broken away, and with a portion of the mating female connector or receptacle being shown in longitudinal section.
Figure 5:
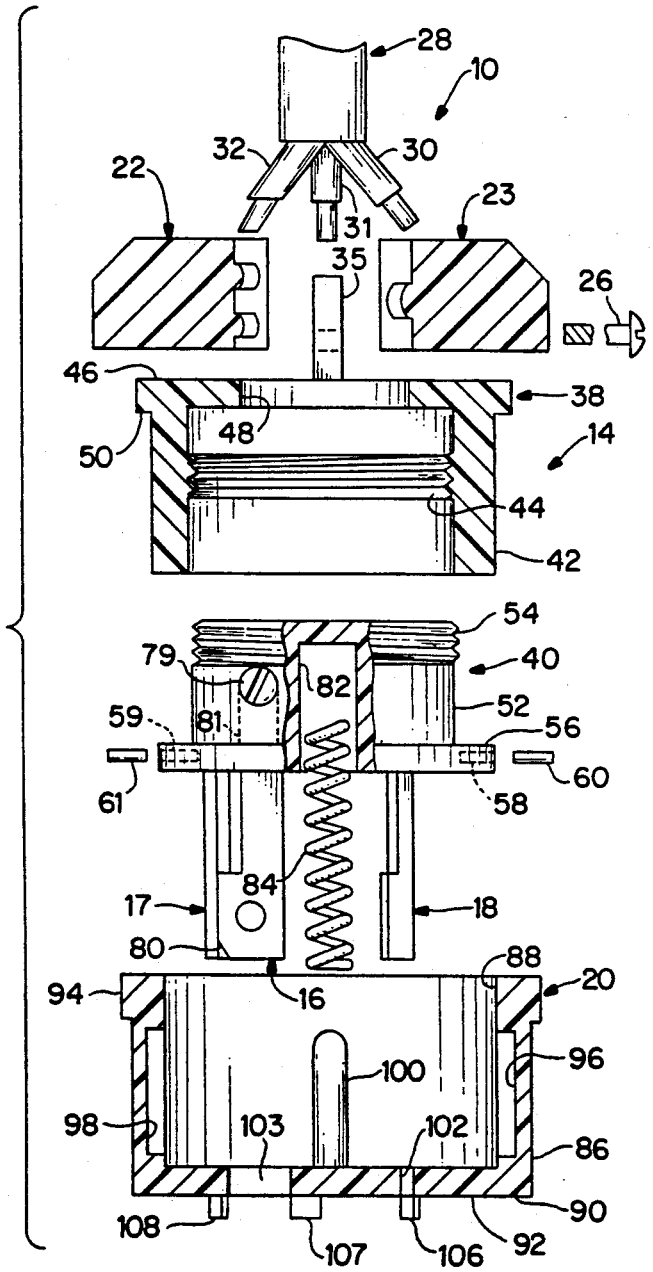
FIG. 5 is an exploded side elevational view of the parts forming the male electrical connector shown in FIGS. 1–4.

Two tabs 34 and 35 are integrally formed with the plug body 14 and extend vertically upwardly from the top thereof as seen in FIGS. 2 and 5, and have suitable transverse throughbores for reception of the screws 25 and 26 to couple the clamps 22 and 23 to the plug body.

The plug body 14 comprises a cover 38, a blade retainer 40, and the three blades 16–18, as seen in FIGS. 1–5.

Cover 38 has a cylindrical sidewall 42, internal threads 44 located substantially centrally along the inside of sidewall 42, an annular top wall 46, a central opening 48 in the top wall, and an annular rim 50 extending radially outwardly from the sidewall to form a stop surface. As best seen in FIGS. 2 and 5, tabs 34 and 35 are integrally formed with the cover 38 and extend upwardly from the top wall 46. Cover 38 is preferably formed of non-conductive plastic.

The blade retainer 40 comprises a non-conductive plastic main body 52 having a cylindrical outer surface, external threads 54 at the top thereof which are threadedly engageable with internal threads 44 on cover 38, and a bottom annular flange 56 extending radially outwardly from the main body and adapted to engage the bottom of sidewall 42 in cover 38. Two diametrically opposed horizontal blind bores 58 and 59 are formed in annular flange 56 and receive in a force fit a pair of pins 60 and 61, which extend outwardly from the flange for slidable connection with the shield 20, as will be described in detail below. Rather than force fit pins, small screws or integral tapered tabs could be used.

Figure 7:
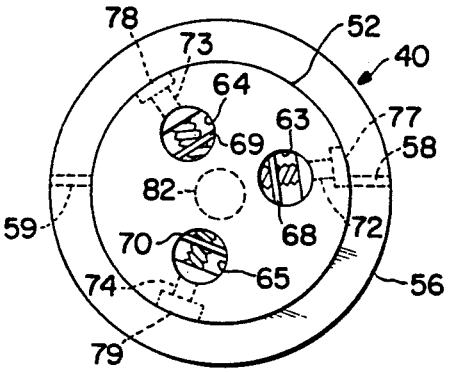
FIG. 7 is a top plan view of the blade retainer shown in FIGS. 1–5.
Figure 8:
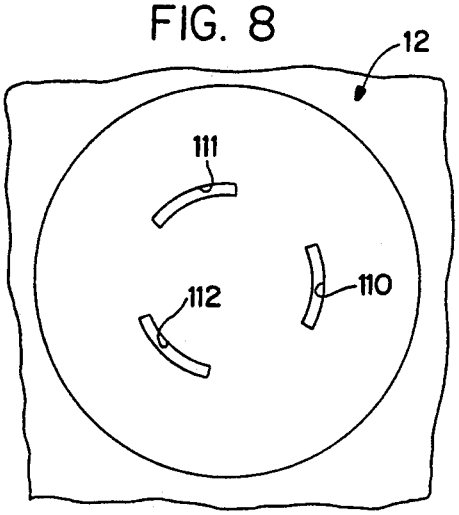
FIG. 8 is a top plan view of the female connector or receptacle shown in FIGS. 2–4, including three curved slots.

As seen best in FIGS. 5 and 7, the main body 52 has three axially directed bores 63–65 formed in the top thereof and spaced about 120° apart, each bore having a metallic plate therein, including plates 68–70, as seen in FIG. 7. The main body 52 also has three horizontally and radially oriented bores 72–74 formed therein and extending from the outer surface thereof, each communicating respectively with one of the vertical bores 63–65. Received in these bores 72–74 are three screws 77–79, respectively. Three axially directed slots, only slot 81 being shown in FIG. 5, extend upwardly from the bottom of the main body 52, and intersect with axial bores 63–65. These slots receive respectively one of the metallic blades 16–18 therein, each of which has a suitable bore therein for reception of one of the screws 77–79. These screws also are rotatably received in suitable threaded bores in each of the plates 68–70. This structure electrically connects the conductors 30–32 to the three blades respectively by having each of the exposed ends of the conductors received between, for example, plate 68 and blade 18 with plate 68 moving towards the blade and clamping the exposed end therebetween upon rotation of screw 77.

As seen in FIGS. 5 and 7, a central axial blind bore 82 extends upwardly from the bottom of the main body 52 and receives a compression spring 84 therein for biasing the shield 20 away from the main body.

The three blades 16–18 are formed of conductive material such as metal, and are slightly curved around their longitudinal axis and have enlarged flags 80 at the end to form each blade in a substantially L-shaped elevational configuration. Rather than three blades, more or less blades could be utilized, such as two or four.

Figure 3:
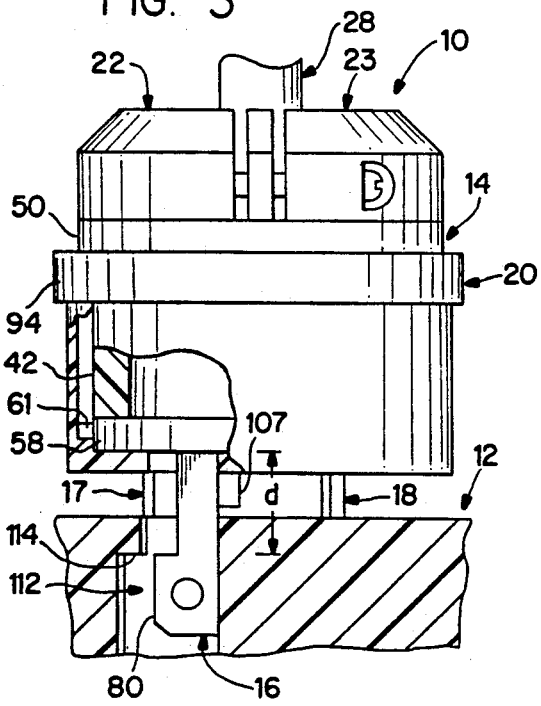
FIG. 3 is a side elevational view of the male electrical connector and the portion of the female receptacle as shown in FIG. 2, except that one of the blades is shown partially received in a slot in the female receptacle.

The shield 20 has a tubular, and preferably cylindrical, support member or sidewall 86 with a first open end 88 and a second end 90 which is closed via a planar bottom disc-shaped wall or plate 92 integrally formed with the sidewall and oriented substantially perpendicular to the longitudinal axis of the sidewall. At the first end 88 of the shield is a top annular flange 94 which extends radially outwardly from the sidewall, and which provides a convenient gripping ledge for moving the shield axially along the plug body. Flange 94 also forms a stop to limit the upward travel of the shield when it engages rim 50 on the plug body as seen in FIG. 3. A pair of diametrically opposed vertical blind slots 96 and 98 are formed in sidewall 86, and slidably receive pins 60 and 61 coupled to the blade retainer 40 therein as seen in FIGS. 1–4 to slidably couple the shield to the blade retainer.

The shield is formed of slightly flexible plastic.

The bottom wall or plate 92 has a central rod 100 extending integrally and upwardly therefrom, and is slidably received within spring 84 to aid in keeping the shield and plug body axially aligned.

Figure 6:
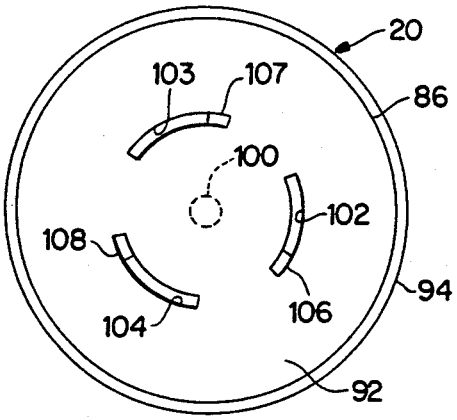
FIG. 6 is a bottom plan view of the shield shown in FIGS. 1–5.

As seen in FIGS. 5 and 6, the bottom wall 92 of the shield also has three through openings or slots 102–104, which are slightly curved and are spaced approximately 120° apart. Each of these slots has a circumferentially directed extent large enough to slidably receive the flag on each of the blades and in operation slidably receives each of the blades therein as indicated in FIGS. 1–4.

Extending axially and integrally downwardly from bottom wall 92 are three slightly curved rigid locking prongs 106–108. Each of the prongs is aligned with one of the slots 102–104, and is located immediately adjacent the trailing edge of one of the slots as seen in FIG. 6. Advantageously, the leading and trailing edges of each of the prongs is substantially planar and parallel to the longitudinal axis A of the shield and plug body as seen in FIGS. 1–5.

Figure 4:
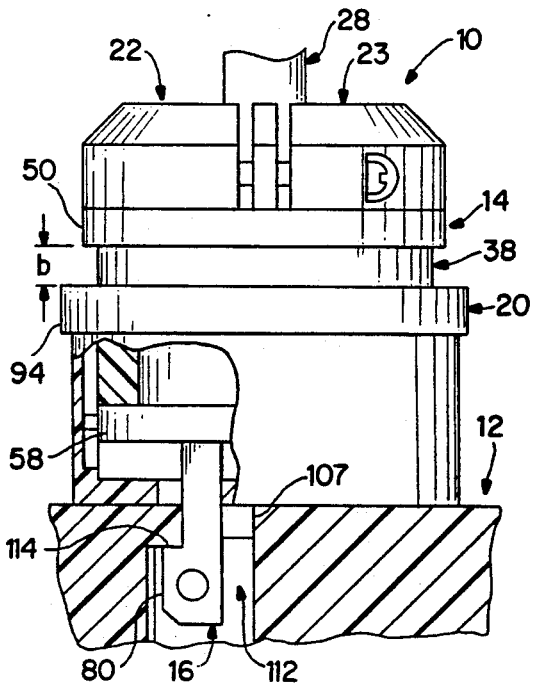
FIG. 4 is a side elevational view of the male electrical connector and the portion of the female receptacle shown in FIG. 3, except that the exposed blade has been fully axially received in the slot in the receptacle and rotated relative thereto, a locking prong on the shield also now being received in the slot.

As seen in FIGS. 2–4 and 8, the female connector or receptacle 12 has three curved slots 110–112, which are spaced substantially 120° apart and have a width in the circumferential direction at least equal to the width of each blade including the flag for axial reception of the blades as illustrated in FIGS. 2–4. Below the outer surface of each of the slots 110–112, each of the slots has a downwardly facing shelf, for example shelf 114 in slot 112, for engaging the upwardly facing edge of the flag 80 as seen in FIG. 4 once the blade is fully inserted and rotated in the slot.

Assembly and Operation

Referring to FIG. 5, the various elements of the male connector 10 are shown prior to assembly, whereas in FIGS. 1–4 they are shown assembled.

To assemble the connector 10, spring 84 is interposed between blade retainer 40 and shield 20 as seen in FIG. 5, and the blade retainer is slid into the shield with the blades 16–18 aligned with slots 102–104 in plate 92, and slidably received therein. Advantageously, the outer diameter of bottom flange 56 on the blade retainer is slightly smaller than the inner diameter of the cylindrical wall 86 in the shield. Spring 84 is slightly compressed, and then pins 60 and 61 are received in bores 58 and 61 in the blade retainer flange 56 and are snapped into slots 96 and 98 in shield 20 to slidably couple the blade retainer and shield together with the blade retainer received in the first open end 88 of the shield.

Next, cable 28 is maneuvered through opening 48 in cover 38, and the exposed ends of conductors 30–32 are received in bores 63–65 in the blade retainer and are electrically connected to the blades by rotation of screws 78–79. Then, cover 38 is rotated onto the blade retainer with internal threads 44 on the cover threadedly engaging external threads 54 on the plug body. Advantageously, when the cover is fully threaded on the blade retainer, the bottom of the cover engages flange 56 on the blade retainer as seen in FIG. 1.

Next, clamps 22 and 23 are positioned on top of the cover with the exposed cable 28 therebetween and screws 25 and 26 are passed through clamp 23, the bores in tabs 34 and 35, and are threadedly engaged with clamp 22 as illustrated in FIG. 2. At this time, the male connector 10 is fully assembled and ready for insertion in the female receptacle 12.

In this fully assembled configuration as seen in FIGS. 1 and 2, the shield 20 is in a first or rest position, under the bias of spring 84, with the tips of the blades extending slightly downwardly past the bottom wall 92. In this position, the axial space "a" between flange 94 on the shield and rim 50 on the cover is substantially equal to the axial distance between the bottom of slots 96 and 98 in the shield and the bottom of pins 60 and 61 on the blade retainer.

To couple connector 10 to female receptacle 12, the blades 16–18 are first aligned with slots 110–112 in the receptacle as indicated in FIG. 2. Then, the blades are axially inserted in the slots, at which time the locking prongs 106–108 abut the top of the receptacle, and continued axial movement of the cover towards the receptacle slides the blades further into the slots and axially slides the cover and blade retainer relative to the shield, the shield wall 86 slidably engaging the exterior surface of wall 42 on the cover. Alternatively, rather than forcing the prongs against the face of the receptacle, the operator can physically slide the shield towards the cover as indicated in FIG. 3 and expose the blades more fully. In this fully retracted or second position, the flange 94 on the shield abuts the rim 50 on the cover.

In all events, once the blades are fully inserted in the slots with each flag being below each shelf in each slot, the entire connector 10 is rotated angularly in a first direction, which is clockwise when viewed from the cable end, so that the flag on each blade translates relative to the shelf and the top of each flag is received under each shelf as indicated in FIG. 4. In this position, each of the locking prongs has space to be received in each slot, and the bias of spring 84 moves the shield and the prongs axially away from the cover so that one of the prongs is received in each of the slots, as seen in FIG. 4. This can be accomplished merely by the operator releasing the shield or by the shield acting on its own via spring 84. In all events, in this position shown in FIG. 4, the male connector 10 is locked to the female receptacle 12 since counter rotation in a second angular direction opposite the first direction to disconnect the connector and receptacle is resisted by reception of the locking prongs in the slots. As is evident from FIG. 4, the circumferentially directed extent of each slot is substantially equal to the circumferentially directed width of each blade above the flag plus the circumferentially directed width of each prong to allow this locking action. Since the leading and trailing edges of each prong is parallel to the axis A of the connector, the locking action is a positive one and cannot be overcome without manipulation of the shield.

In this position, the male connector 10 also cannot be pulled axially away from the female receptacle 12 due to the engagement of the flag on each blade with the shelf in each slot.

To disconnect the connector and receptacle, the operator must grasp the shield 20 preferably at flange 94 and move it axially towards the cover so that the prongs are pulled axially out of the slots in the receptacle. Then, the connector 10 can be rotated in the second angular direction relative to the slots, thereby freeing the flags on each blade from the shelf in each slot. Finally, the connector can be pulled axially upwardly and away from the receptacle to release the blades from the slots.

As indicated in FIG. 4, advantageously the axial distance "b" remaining between the top of flange 94 on the shield and the bottom of rim 50 on the cover is at least as long as the axial extent of the prongs so that the shield can be moved upwardly a sufficient distance to free the prongs from the slots. In addition, the axial distance "d" between the bottom of flange 58 on the blade retainer and the top of the flag 80 on each blade is greater than the combined axial extent of each prong and the shelf in each slot, so that the blades can be inserted and rotated in each slot.

Figure 9:
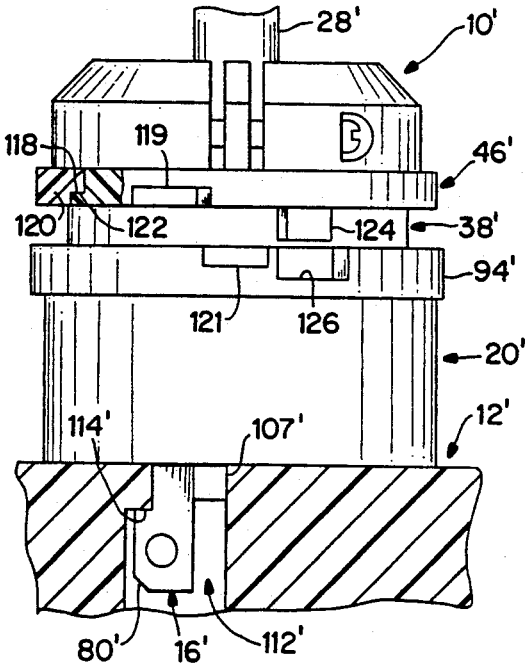
FIG. 9 is a side elevational view in partial section of a second embodiment of the male electrical connector in accordance with the invention in which an additional tab and slot arrangement is provided to provide selective lock-in of the connector to the female receptacle.
Figure 10:
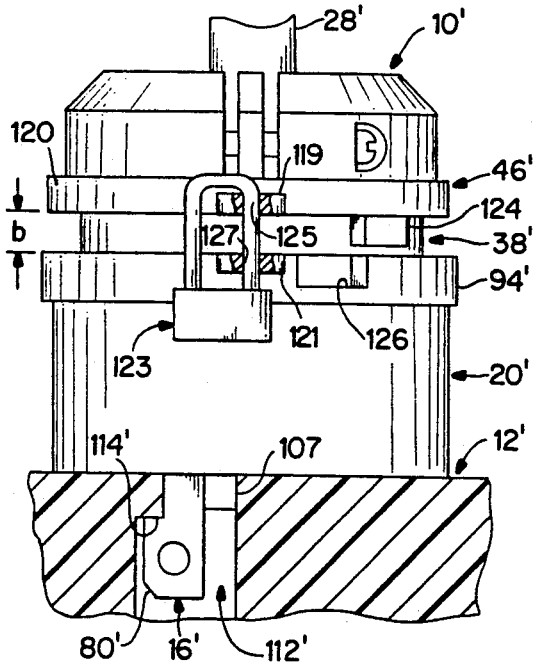
FIG. 10 is a side elevational view of the electrical connector shown in FIG. 9 with the tab rotated away from the slot to lock the connector to the female receptacle.

Embodiment of FIGS. 9–10

Illustrated in FIGS. 9 and 10 is a modified second embodiment of the invention with an auxiliary lock-in assembly to resist inadvertent or unwanted disconnection of the male electrical connector from the female receptacle.

In the embodiment of FIGS. 9 and 10, the structure of the connector and receptacle is substantially the same as that disclosed in FIGS. 1–8, with the exception of a modification to the cover and the shield. Thus, like reference numerals with a prime are used for the similar structure set forth in FIGS. 1–8.

The male electrical connector 10' in accordance with the invention includes an annular groove 118 in the top wall 46' of the cover 38' and a ring 120 having a mating downwardly facing annular groove 122 therein which slidably and rotatably engages groove 118. Extending rigidly axially downwardly from ring 120 is a rigid tab 124 that is free to move circumferentially around the rest of the cover 38' when the ring 120 is rotated.

The shield 20' has an upwardly facing axial slot 126 in its upper flange 94' that has a circumferentially directed width slightly greater than the width of tab 124 and a depth of at least the axial depth of tab 124, which is equal to or slightly less than dimension "b".

Thus, with the male electrical connector 10' in its locked position shown in FIG. 9, which is substantially the same as that shown in FIG. 4 for connector 10, tab 124 and slot 126 are axially aligned. Therefore, shield 20' can be moved axially upwards away from the receptacle 12' and towards the ring 120 to begin disconnection of the connector from the receptacle as desired.

However, to more securely lock the connector to the receptacle, the ring 120 from the position shown in FIG. 9 can be rotated in the circumferential direction to a position shown in FIG. 10. In this position, tab 124 is no longer axially aligned with slot 126 and thus, if shield 20' is moved vertically upwardly, it will engage the bottom of the tab, thereby preventing any further upward movement. Since this upward movement is resisted, the locking prongs cannot be removed from the slots in the receptacle and therefore the connector cannot be unlocked from the receptacle. To allow unlocking, tab 124 can be moved back to alignment with slot 126, and the disconnection operation discussed above regarding FIGS. 1–8 can be accomplished.

To prevent unauthorized removal of the connector 10' from receptacle 12', radially extending tabs 119 and 121 are rigidly coupled to ring 120 and flange 94' and receive the shackle of a padlock 123 in their respective throughbores 125 and 127 when the tabs 119 and 121 are aligned in the circumferential direction shown in FIG. 10. In this configuration, the connector 10' can be removed from the receptacle 12' only after unlocking of the padlock 123.

Figure 11:
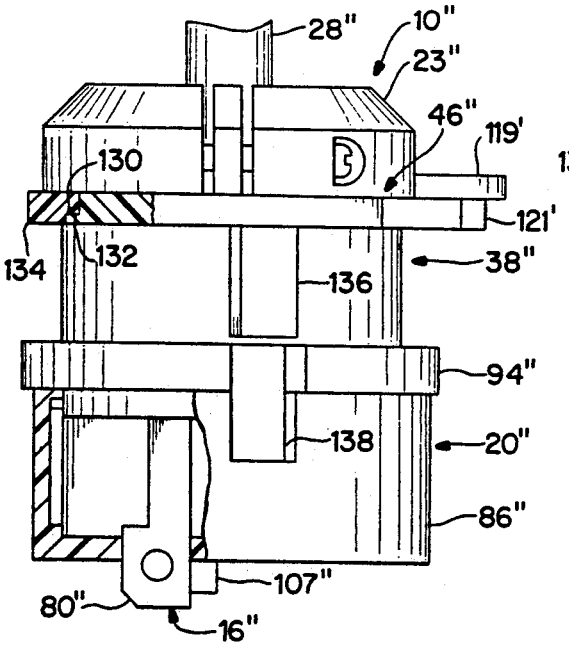
FIG. 11 is a side elevational view of a third embodiment of the electrical connector in accordance with the invention in which the tab and slot arrangement are used to lock out the connector from connecting with a female receptacle.
Figure 12:
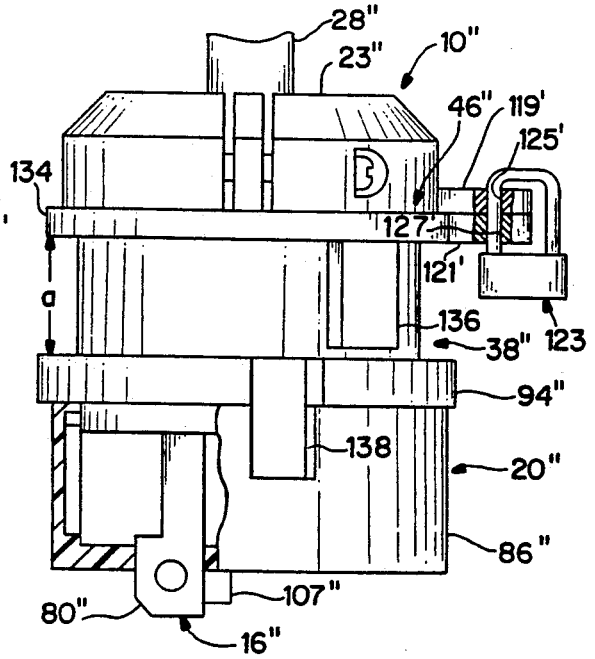
FIG. 12 is a side elevational view of the connector shown in FIG. 11 with the tab angularly displaced from the slot to provide the lock-out feature.

Embodiment of FIGS. 11-12

In FIGS. 11-12, a third embodiment in accordance with the invention is illustrated in which the male electrical connector can be locked out of possible connection with a receptacle. This is now required by many OSHA regulations in order to, for example, disable operation of a machine while it is being repaired.

Modified male electrical connector 10" shown in FIGS. 11-12 is substantially the same as that shown in FIGS. 1-8 and like reference numerals will be used for like parts with the addition of a double prime. This embodiment is also similar to that shown in FIGS. 9-10; however, the axial tab is made longer and the axial slot is likewise made longer.

Thus, top annular wall 46" on the cover 38" has an annular groove 130 which slidably and rotatably receives a mating annular groove 132 on a separate ring 134. Rigidly coupled to the ring and extending downwardly and integrally therefrom is a tab 136 which has an axial extent of equal to or slightly less than dimension "a". Formed in shield 20" is an axially extending and upwardly opening slot 138 which is formed through flange 94" and part of sidewall 86" therein. Slot 138 has a circumferentially directed width substantially equal to but slightly greater than the circumferentially directed width of tab 136 and has an axial length substantially equal to or slightly greater than the length of tab 136 for slidable reception of the tab in the slot.

As positioned in FIG. 11, tab 136 and slot 138 are axially aligned and therefore shield 20" can be slid axially upwardly towards annular wall 46' on the cover, thereby exposing the blades and allowing connection of the connector 10" with a suitable receptacle.

However, to lock out the connector and prevent it from being connected to a receptacle, ring 134 can be rotated relative to the cover and shield so that tab 136 no longer axially aligns with slot 138 as indicated in FIG. 12. In this position, upward movement of shield 20" is resisted by engagement of flange 94" with the bottom of tab 136. To allow connector 10" to be connected to a receptacle, ring 134 is simply rotated back to the position shown in FIG. 11 in which the tab and slot are aligned.

To prevent unauthorized connection of connector 10" to a receptacle, radially extending tabs 119' and 121' are rigidly coupled to the clamp 23" and ring 134 and receive the shackle of a padlock 123' in their respective throughbores 125' and 127' when the tabs 119' and 121' are aligned in the circumferential direction shown in FIG. 12. In this configuration, connector 10" can be connected to a receptacle only after unlocking and removal of padlock 123' and relative movement of tab 136 and slot 138. Instead of supporting tab 119' on clamp 23", the tab can be supported on an additional ring located above ring 134 and rigidly coupled to the connector to resist rotation.

Although the embodiments of FIGS. 9 and 10 on the one hand and FIGS. 11 and 12 on the other are shown separately, it is contemplated that the lock-in features of FIGS. 9 and 10 can be combined with the lock-out features of FIGS. 11-12. Such a single device would be constructed to include the axial tabs and slots shown in these figures; however, the circumferentially directed width of slot 138 would have to be doubled to allow the lock-in feature in combination with the lock-out feature.

Figure 13:
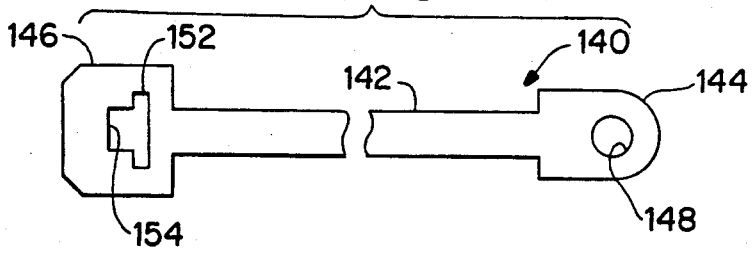
FIG. 13 is a side elevational view of a lock-in band used to prevent axial movement of a shield on the connector and maintain the connector in a locked configuration.
Figure 14:
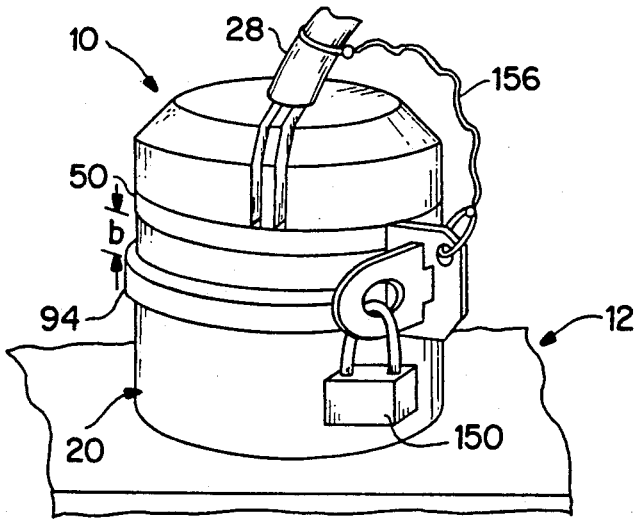
FIG. 14 is a side elevational view in perspective of the electrical connector as shown in FIG. 4 in the connected position with the lock-in band of FIG. 13 coupled thereto.

Embodiment of FIGS. 13-14

FIGS. 13 and 14 illustrate a fourth embodiment of the present invention which utilizes the male electrical connector 10 from FIGS. 1-8 with the addition of a lock-in band 140. The purpose of band 140 is to lock the electrical connector 10 in its connected position illustrated in FIG. 14 as well as FIG. 4.

Lock-in band 140 comprises a main band portion 142 and first and second coupling members 144 and 146 at opposite ends thereof. First coupling member 144 is substantially D-shaped, and has an opening 148 therein for ultimate engagement with the shackle of a key lock 150. The second coupling member 146 is substantially rectangular in shape, and has a first slot 152 dimensioned to receive the first coupling member 144 therethrough, and a second or counter slot 154 at a side thereof for slidable reception of the main band portion 142 as seen in FIG. 14. Thus, the height of the second slot 154 is substantially equal to the height of the main band portion 142.

Once the connector 10 is connected and locked to the receptacle 12 as indicated in FIGS. 4 and 14, the band 140 can be wrapped around the cover 38 and positioned between the annular rim 50 on the cover and the annular flange 94 on the shield. The axial extent of this distance is shown as "b" and is substantially equal to the axial width of the band 140 along it main band portion 142. The first coupling member 144 is then inserted through slot 152 and the main band portion 142 is then received in second slot 154. Lock 150 can then be applied through opening 148 in the first coupling member to prevent removal of the lock-in band 140. Advantageously, a lanyard 156 can be suitably connected to cable 28 and band 140 so that the band is not removed from the connector.

Advantageously, the lock-in band 140 is made of spring steel so that it resists axial movement of the shield and cover and also so that the first and second coupling members are biased together. Alternatively, the lock-in band 140 can be made of any other suitable material such as plastic or heavy fabric, and the coupling members can be any other suitable coupling members such as hook and loop fasteners.

Figure 15:
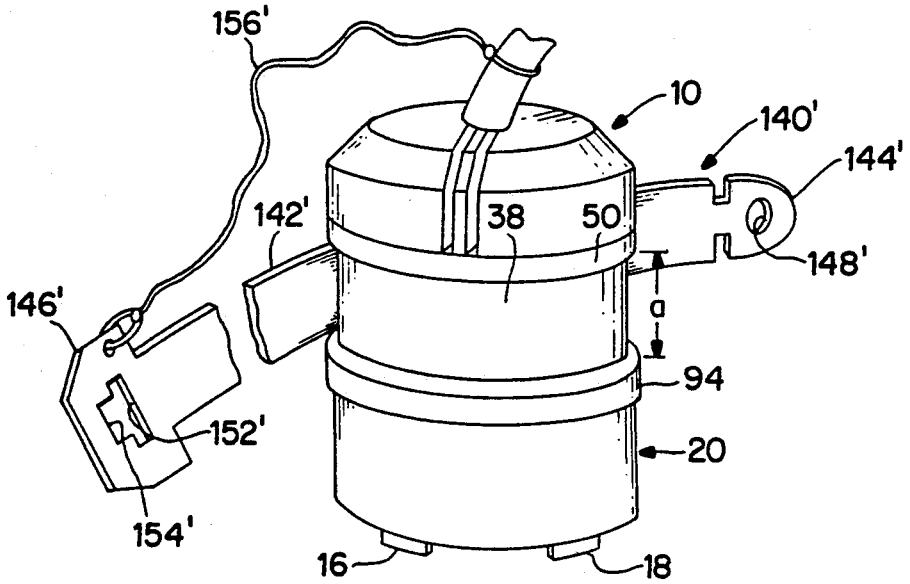
FIG. 15 is a side elevational view of the electrical connector as shown in FIG. 4 with a modified wider band for use to lock out the connector from engagement with a female receptacle.

Embodiment of FIG. 15

As seen in FIG. 15, a fifth embodiment in accordance with the invention is illustrated using the male electrical connector 10 as shown in FIGS. 1-8 with the addition of a modified band 140' which is similar to band 140 shown in FIGS. 13-14; however, this band 140' is a wider lock-out band. The structure of band 140' is the same as that shown in FIGS. 13-14, except that the main band portion 142' is axially wider and has a dimension of "a" which is substantially equal to the distance between rim 50 on the cover and flange 94 on the shield as shown in FIG. 2.

Thus, the lock-out band 140' is wrapped around the cover 38, and is interposed between rim 50 and flange 94 when the connector 10 is in its first or rest position shown in FIG. 2. Once the band is secured around the cover, the shield 20 cannot move towards the rim 50 on the cover and therefore the blades 16-18 cannot be exposed. Thus, connector 10 cannot be installed with a receptacle, and inadvertent connection thereof is prevented.

Such a lock-out feature would satisfy current OSHA requirements and band 140' can be more permanently coupled to the connector 10 by using a lock similar to lock 150 shown in FIG. 14. In addition, band 140', as well as band 140 shown in FIGS. 13–14, can bear various indicia indicating that the connector is either locked out or locked in as the case may be to apprise any observers of the connector's condition.

Embodiment of FIGS. 16–21

FIGS. 16–21 illustrate a sixth embodiment of the present invention. It is similar to the embodiment shown in FIGS. 1–8; however, the full shield is not used and instead the locking prongs are merely mounted on an axially slidable plate received in a recess in the blade retainer. The trailing edges of the locking prongs are tapered so that the connector can be released from its locking position by rotation, which is sufficient to overcome the force of a spring pushing down on the locking prongs.

The modified male electrical connector 160 shown in FIGS. 16–21 comprises a plug body 162 including a cover 164, a blade retainer 166 and three blades 168; first and second clamps 170 and 172; electrical cable 174; and a slidable plate 176.

Clamps 170 and 172 are similar to those discussed above regarding FIGS. 1–8, and will not be discussed in detail. Similarly, the connection of the electrical cable 174 to the blade retainer 176 is likewise similar, and will not be discussed in detail, as is the threaded connection of the blade retainer 166 to the cover 164.

Figure 16:
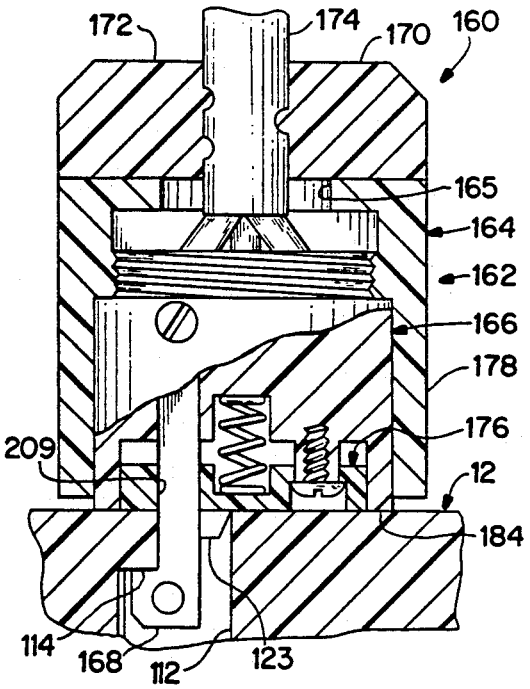
FIG. 16 is a side elevational view in substantially longitudinal section of a modified embodiment of the electrical connector in accordance with the invention in which a plate rather than a cup-shaped shield carries the locking prongs, these prongs being in the locked position as shown in FIG. 16.
Figure 17:
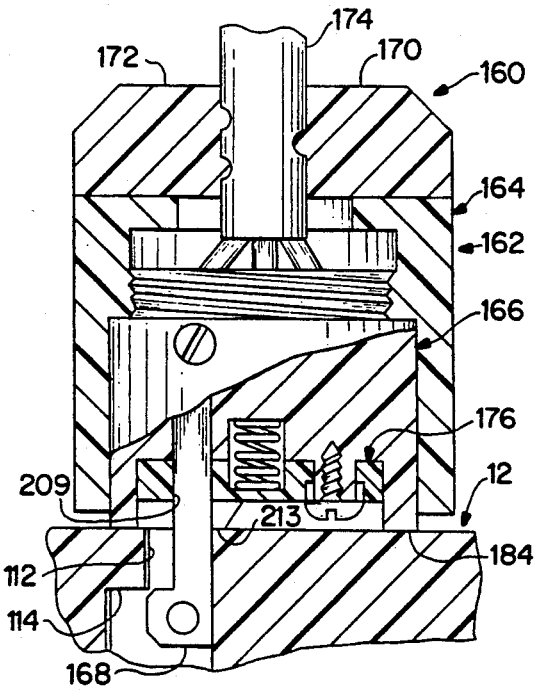
FIG. 17 is a side elevational view in substantially longitudinal section of the modified electrical connector shown in FIG. 16 with the plate and locking prongs shown in their retracted position.

In this embodiment, the cover 164 has a cylindrical sidewall 178 which, as seen in FIGS. 16 and 17, ends above the bottom edge of the blade retainer 166.

Figure 18:
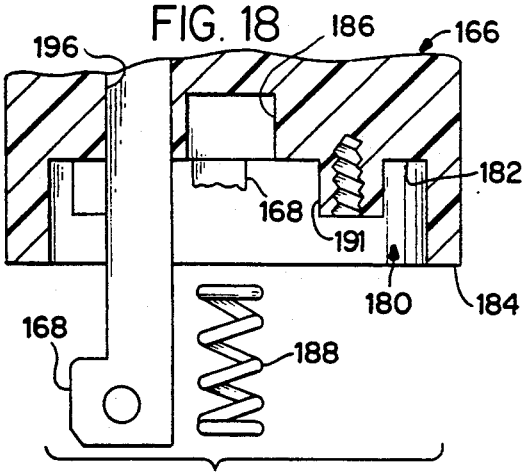
FIG. 18 is a partial enlarged side elevational view in section taken substantially along line 18—18 in FIG. 20 of the bottom of the blade retainer shown in FIGS. 16 and 17.
Figure 20:
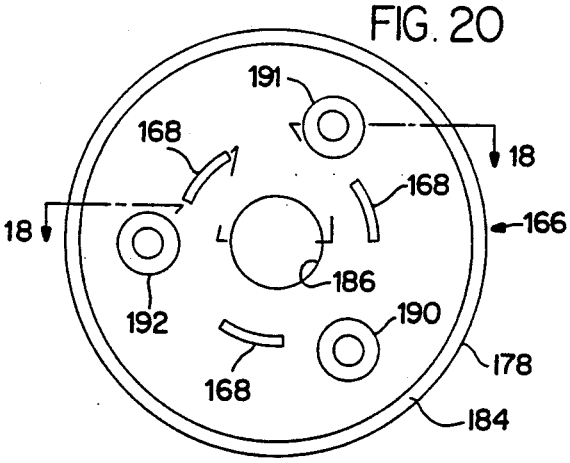
FIG. 20 is a bottom plan view of the blade retainer shown in FIGS. 16–18.

As seen in FIGS. 16–20, the blade retainer 166 has a recess 180 formed in the bottom thereof having an upper planar wall 182 and a cylindrical sidewall 184. Extending upwardly from wall 182 is a cylindrical central blind bore 186 which receives a portion of a compression spring 188 therein. Extending integrally downwardly from upper wall 182 are three cylindrical projections 190–192 which are spaced apart in the circumferential direction by approximately 120°. Each of the central bores in the projections is threaded to threadedly receive a mounting screw 194 therein. Suitable axial slots extend upwardly from the upper wall 182 for reception of the blades therein and electrical connection with the cable in the blade retainer as described above regarding FIGS. 1–8. One of these slots is shown in FIG. 18 and designated by reference numeral 196.

Plate 176 is substantially planar and disc-shaped, and has an upwardly opening central blind bore 198 therein for engaging the other end of spring 188. Plate 176 also has three throughbores 200–202 separated in the circumferential direction by 120°, each of these bores having respectively a larger diameter downwardly facing counterbore 204–206. The smaller bores 200–202, respectively, slidably receive projections 190–192 therein, and the heads of mounting screws 194 engage the bottom of the counterbores 204–206 to prevent the plate 176 from moving off the blade retainer. In addition, the screws form a stop to maintain the plate 176 in a first or rest position shown in FIG. 16 spaced from the upper wall 182 of the recess 180 against the force of compression spring 188.

Passing through the axial thickness of plate 176 are three thin curved slots 208–210 for the slidable reception of the blades 168 therein. As shown in FIGS. 16–21, the circumferential extent of slots 208–210 are not as wide as the flags on the blades, although they could be, as desired. In this case then, the upper portion of the blades can be maneuvered through the slots and then the blades attached to the blade retainer 166.

Figure 19:
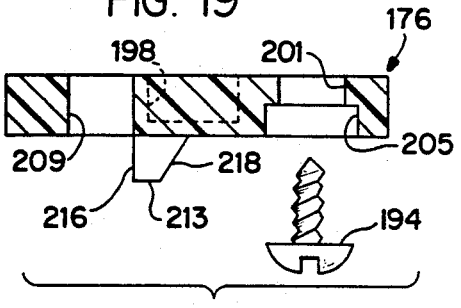
FIG. 19 is an enlarged side elevational view in section taken substantially along line 19—19 in FIG. 21 of the plate and locking prongs used in FIGS. 16 and 17.
Figure 21:
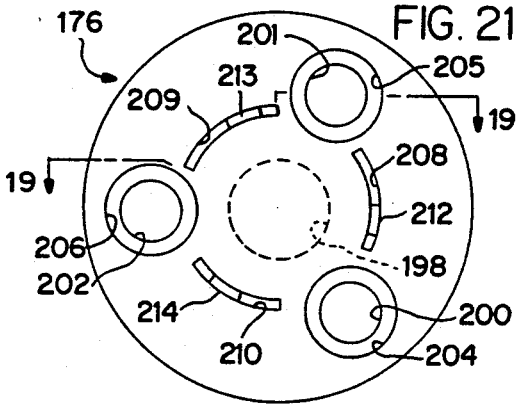
FIG. 21 is a bottom plan view of the plate and locking prongs shown in FIGS. 16, 17 and 19.

Extending downwardly and integrally from the bottom of plate 176 are three locking prongs 212–214 which are slightly curved and which are positioned respectively adjacent the trailing edge of one of the slots. As seen in FIG. 19, the forward edge 216 of each prong is substantially planar and parallel to the longitudinal axis of the plate, while the trailing edge 218 tapers downwardly and towards the leading edge at an angle of about 45°. The resistance to unlocking is a function of both the prong angle and the force of spring 188. Therefore, the angle is selected to achieve the desired locking resistance and in practice can range from 10° to 45°.

To assemble the electrical connector 160 in accordance with FIGS. 16–21, the blades 168 are passed through their respective slots in the plate 176 and attached to the blade retainer, spring 188 is interposed between the plate and the blade retainer, and the mounting screws 194 are passed through bores 200–202 and threaded to the projections in the blade retainer. This slidably couples the plate 176 to the blade retainer 166 between the first, fully extended position shown in FIG. 16 and a second, fully retracted position shown in FIG. 17. Then, the cable 174 is passed through the central opening 165 in cover 164 and electrically connected to the blades. Next, the cover 164 is threadedly coupled to the blade retainer and the clamps 170 and 172 are coupled to the cover and cable.

The male electrical connector 160 in accordance with the embodiment of FIGS. 16–21 works substantially similarly to the embodiment of FIGS. 1–8; however, there is no outer wall to grasp and axially retract to release the connector.

Thus, to lock the electrical connector 160 to receptacle 12, the blades 168 are once again aligned with the slots 112–114 in the receptacle and axially inserted. During this axial insertion, the locking prongs engage the top face of the receptacle which drives the plate 176 axially upwardly towards the upper wall of the recess in the blade retainer. Insertion is continued until the bottom edge of the sidewall 184 of the blade retainer engages the receptacle, the plate is adjacent the blade retainer, and the flags 80 on the blades are below the shelves 114 in the slots. This position is shown in FIG. 17. While FIG. 17 shows the plate up against the blade retainer, there could be some additional space therebetween.

Next, the electrical connector 160 is rotated angularly in a first direction, which is clockwise as viewed from the cable end, relative to the receptacle 12 and the blades translate from the position shown in FIG. 17 to that shown in FIG. 16 with the flag on the blade being received under the shelf in the slot. When the connector 160 is so rotated, the locking prongs also move angularly, and are then located over the now empty trailing ends of the slots and are biased downwardly into the slots via spring 188. This locks the connector 160 against relative rotation in a second opposite direction with the receptacle under normal forces. However, if a sufficient torque in the second opposite rotational direction is applied to the connector 160, this will overcome the downward force of spring 188 and allow the tapered trailing edge 218 of each prong to cam against the edge of each slot, resulting in an upward movement of the plate 176 from a position shown in FIG. 16 to a position shown in FIG. 17. Then, the connector can be axially pulled out of the receptacle, since the flags are no longer received under the shelves in the slots.

Figure 22:
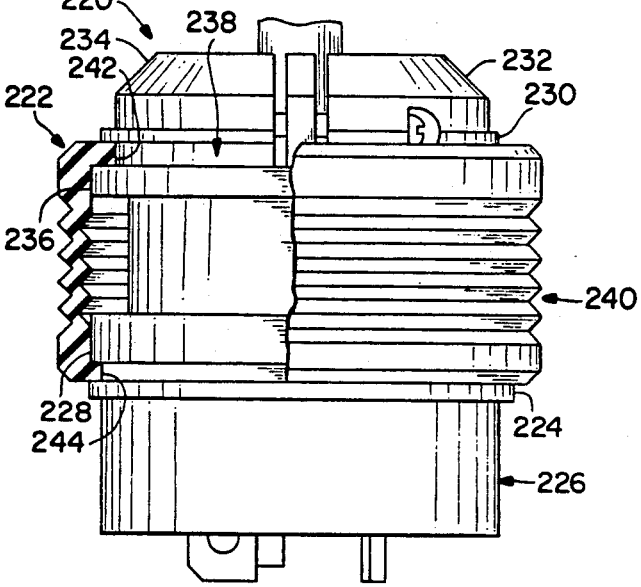
FIG. 22 is a side elevational view in partial section of a modified embodiment of the invention in which an elastomeric seal is received on the connector to seal the interface between the connector's plug body and slidable shield.

Embodiment of FIG. 22

FIG. 22 illustrates a seventh embodiment of the invention which includes a male electrical connector 220 having an elastomeric tubular seal 222. Connector 220 is substantially the same as connector 10 shown in FIGS. 1–8 with the addition of seal 222, ring 224 on shield 226 below flange 228 thereon, and ring 230 formed on clamping members 232 and 234 above rim 236 on plug body 238. Seal 222 is made of resilient elastomeric material and includes a central corrugated portion 240, an upper annular, inwardly-facing projection 242 at one end, and a lower annular, inwardly-facing projection 244 at the other end. Projection 242 is received between ring 230 and rim 236 to rigidly engage and couple the seal 222 to the plug body 238, and projection 244 is received between flange 228 and ring 224 to rigidly engage and couple the seal 222 to the shield 226.

The seal 222 thereby seals the interface between the inner surface of the shield 226 and the outer surface of the plug body 238 along which the shield slides. This structure resists entrance of dirt or moisture into the inside of connector 220. When shield 226 is moved upwards towards the plug body 238, the corrugated portion 240 can absorb the axial compression of the seal 222.

When seal 222 is shown in FIG. 22 coupled to the connector 220 by annular projections, it could be coupled thereto in additional ways.

Figure 23:
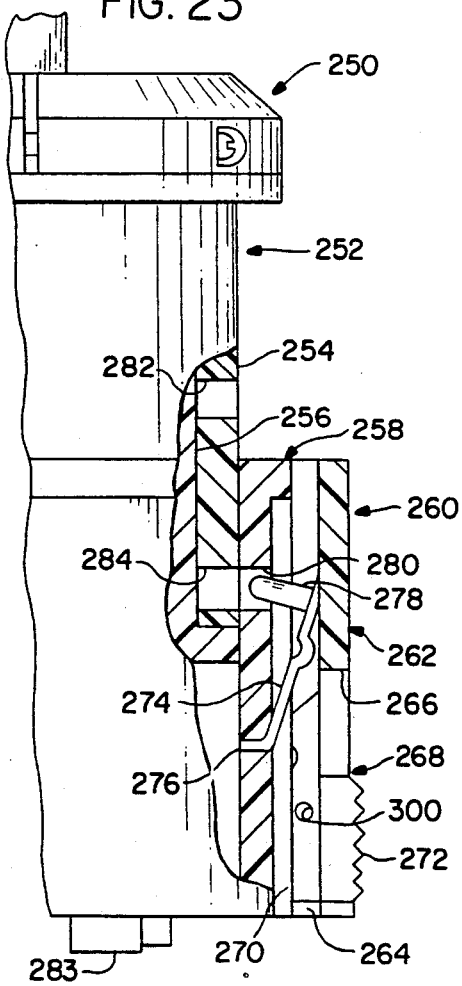
FIG. 23 is a fragmentary, side elevational view in partial section of a further modified embodiment of the invention in which a combined lock-out and lock-in slide assembly is coupled to the connector's shield and has a pin for selective engagement with openings in the plug body.

Embodiment of FIG. 23

FIG. 23 illustrates an eighth embodiment of the invention which includes a male electrical connector 250 having a plug body 252 including a sidewall or cover 254 and a blade retainer 256, and a shield 258 slidably engaged on the outside of the cover 254. The connector 250 is substantially the same as connector 10 shown in FIGS. 1–8 with the addition of a combined lock-out and lock-in slide assembly 260 rigidly coupled to the shield 258, in any suitable manner.

Slide assembly 260 comprises an elongated body member 262 having a T-shaped slot 264 on the inside extending the axial length of the body member and an outer slot 266 extending about one-half the axial length of the body member; and a slider 268 having an actuating plate 270 slidably received in T-shaped slot 264 and a gripping member 272 slidably received in outer slot 266 and coupled to actuating plate 270. Forming part of the slide assembly 260 is a resilient steel leaf spring 274 having a tang 276 at one end rigidly received in the shield and a rigid pin or projection 278 rigidly supported at the other end, projection 278 normally being received in T-shaped slot 264 adjacent the end of slider 268 and in a through opening 280 in shield 258.

In this embodiment, cover 254 has two axially spaced and aligned, radially directed openings, upper opening 282 and lower opening 284, which are sized to receive the end of projection 278 therein after spring 274 is pivoted towards the shield. This pivoting is accomplished by axially sliding the slider 268 towards and into slidable engagement with the spring 274.

In the position shown in FIG. 23, openings 280 and 284 are aligned, the connector 250 is in its rest position, and projection 280 can be moved into a position in which it is received in both openings via axial movement of the slider 268 towards the spring 274. In this configuration, the connector 250 is locked out from engagement with a female receptacle since shield 258 cannot move axially towards the plug body 252 to expose the blades 283 due to reception of the projection 278 in openings 280 and 284.

The connector 250 similarly can be locked into engagement with a female receptacle by actuation of slider 268 when the blades 283 of the connector are fully received and translated in the slots of the receptacle, as in FIG. 4 above, at which time upper opening 282 in the cover 254 is aligned with opening 280 in the shield and projection 278 can be pivoted into reception in both of these openings.

Embodiment of FIGS. 24–25

FIGS. 24–25 illustrate a ninth embodiment of the invention which includes a male electrical connector 250' that is similar to connector 250 in FIG. 23 except that the lock-out and lock-in slide assembly 260' is rigidly coupled to the plug body cover 254' and the shield 258' is slidably received inside the cover 254'.

In this embodiment, plug body 252' comprises cover 254', blade retainer 256', and an annular support 286 which is snap-fitted to the cover 254' via a set of spaced pins 288 in the cover receivable in a set of spaced slots 290 in the annular support 286.

Slide assembly 260' works substantially the same as slide assembly 260 in FIG. 23 except that lock-out requires use of upper opening 282' while lock-in requires use of lower opening 284'. The elements shown in FIGS. 24–25 which are similar to those in FIG. 23 are given the same reference numerals with the addition of a prime.

FIG. 25 shows a mechanism for applying a padlock 292' to connector 250' so that the lock-out or lock-in positions can be changed only by unlocking the padlock.

Padlock 292' can be applied to a safety-pin like structure 294' which has one leg 296' received through opposed holes in body member 262', hole 298' being shown in FIG. 25, and a transverse hole 300' in plate 270' in slider 268' as seen in FIG. 24. Padlock 292' and structure 294' can also be used with the slide assembly 260 in FIG. 23.

While advantageous embodiments have been chosen to illustrate the invention, it will be understood by those skilled in the art that various changes and modifications can be made therein without departing from the scope of the invention as defined in the appended claims.

What is claimed is:

1. A male electrical connector, the combination comprising:

an insulating plug body adapted to receive an electrical cable, and having a plurality of conductive blades extending therefrom, said blades being shaped and dimensioned for insertion into and translation in slots formed in a mating female connector as said plug body is moved axially and rotationally about the plug body axis, respectively, relative to the female connector;

a plate having a plurality of openings, each of the openings slidably receiving one of said blades therein;

means, coupled to said plate and said plug body, for slidably coupling said plate and said plug body between first and second positions;

locking means, extending from sad plate and receivable in at least one of the slots in the female connector once the blades are inserted into and translated in the slots, for resisting relative rotational translation of said plug body and the female connector; and means for rigidly coupling said locking means to said plate.

2. A male connector according to claim 1, wherein said locking means comprises a plurality of prongs rigidly coupled to said plate.

3. A male connector according to claim 1, wherein said locking means comprises at least one prong rigidly coupled to said plate.

4. A male connector according to claim 1, and further comprising biasing means, coupled to said plate and plug body, for biasing said plate away from said plug body into said first position spaced from said plug body.

5. A male electrical connector according to claim 1, wherein said plug body has a recess, said plate being slidably received in said recess.

6. A male connector according to claim 1, wherein said plug body has an exterior surface, and said means for slidably coupling said plate and said plug body comprises a support member rigidly coupled to said plate and slidably engaging said plug body exterior surface.

7. A male connector according to claim 6, wherein said support member is tubular.

8. A male connector according to claim 6, wherein said support member is cylindrical.

9. A male connector according to claim 1, and further comprising lock-out means, coupled to said plug body, for preventing said plate from moving towards said plug body when said plate is in said first position.

10. A male connector according to claim 9, wherein said lock-out means comprises a flexible band receivable around said plug body and having coupling means at the ends thereof.

11. A male connector according to claim 9, wherein said lock-out means comprises a rigid tab extending axially along said plug body.

12. A male connector according to claim 9, wherein said lock-out means comprises a rigid projection extending radially of said plug body and receivable in a radially-directed opening in said plug body.

13. A male connector according to claim 9, wherein said lock-out means further comprises means for receiving the shackle of a padlock therein.

14. A male connector according to claim 1, and further comprising lock-in means, coupled to said plug body, for preventing said plate from moving further towards said plug body after said plate has moved from said first position and said blades have been fully received in the slots in the female connector.

15. A male connector according to claim 14, wherein said lock-in means comprises a flexible band receivable around said plug body and having coupling means at the ends thereof.

16. A male connector according to claim 14, wherein said lock-in means comprises a rigid tab extending axially along said plug body.

17. A male connector according to claim 14, wherein said lock-in means comprises a rigid projection extending radially of said plug body and receivable in a radially-directed opening in said plug body.

18. A male connector according to claim 14, wherein said lock-in means further comprises means for receiving the shackle of a padlock therein.

19. A male electrical connector, the combination comprising:

an insulating plug body adapted to receive an electrical cable, having an exterior surface, and having a plurality of conductive blades extending therefrom;

a shield comprising a tubular wall having first and second ends, and a plate rigidly coupled to said tubular wall at said second end, said plate having a plurality of openings, each opening slidably receiving one of said blades therein, said plug body being received in said first end;

means, coupled to said shield and said plug body, for slidably coupling said shield and said plug body between first and second positions;

biasing means, coupled to said shield and said plug body, for biasing said plate away from said plug body into said first position in which said plate is spaced from said plug body, said shield tubular wall slidably engaging said plug body exterior surface, and locking means, coupled to said plug body, for selectively preventing said shield from sliding into said second position.

20. A male connector according to claim 19, wherein said locking means comprises lock-out means, coupled to said plug body, for preventing said plate from moving towards said plug body when said plate is in said first position.

21. A male connector according to claim 20, wherein said lock-out means comprises a flexible band receivable around said plug body, having coupling means at the ends thereof and engageable with said shield.

22. A male connector according to claim 20, wherein said lock-out means comprises a rigid tab extending axially along said plug body exterior surface, means for supporting said tab for angular translation relative to said plug body, and an axially directed slot formed in said shield for selective reception of said tab therein.

23. A male connector according to claim 20, wherein said lock-out means comprises a rigid projection extending radially of said plug body and receivable in a radially-directed opening in said plug body and a radially-directed opening in said shield

24. A male connector according to claim 20, wherein said lock-out means further comprises means for receiving the shackle of a padlock therein.

25. A male connector according to claim 19, wherein said locking means comprises lock-in means, coupled to said plug body, for preventing said plate from moving further towards said plug body after said plate has moved from said first position and said blades have been fully received i the slots in a female connector.

26. A male connector according to claim 25, wherein said lock-in means comprises a flexible band receivable around said plug body, having coupling means at the ends thereof, and engageable with said shield.

27. A male connector according to claim 25, wherein said lock-in means comprises a rigid tab extending axially along said plug body exterior surface, means for supporting said tab for angular translation relative to said plug body, and an axially directed slot formed in said shield for selective reception of said tab therein.

28. A male connector according to claim 25, wherein said lock-in means comprises a rigid projection extending radially of said plug body and receivable in a radially-directed opening in said plug body and a radially-directed opening in said shield.

29. A male connector according to claim 25, wherein said lock-in means further comprises means for receiving the shackle of a padlock therein.

30. A male electrical connector, the combination comprising:

an insulating plug body adapted to receive an electrical cable, and having a plurality of conductive blades extending therefrom;

a shield comprising a tubular wall having first and second ends, and a plate rigidly coupled to said tubular wall at said second end, said plate having a plurality of openings, each opening slidably receiving one of said blades therein;

means, coupled to said shield and said plug body, for slidably coupling sad shield and said plug body between first and second positions; and locking means, coupled to said plug body and selectively movable relative to said shield and said plug body, for selectively preventing said shield from sliding relatively towards said plug body into said second position.

31. A male connector according to claim 30, and further comprising biasing means, coupled to said shield and plug body, for biasing said plate away from said plug body into said first position in which said plate is spaced from said plug body.

32. A male connector according to claim 30, wherein said locking means comprises a flexible band.

33. A male connector according to claim 30, wherein said locking means comprises a rigid tab extending axially of said plug body.

34. A male connector according to claim 30, wherein said locking means comprises a rigid projection extending radially of said plug body.

35. A male connector according to claim 30, and further comprising means, engaging said plug body and shield, for sealing the interface between said plug body and shield.

36. A male electrical connector, the combination comprising:

an insulating plug body adapted to receive an electrical cable, and having a plurality of conductive blades extending therefrom, said blades being shaped and dimensioned for insertion into and translation in slots formed in a mating female connector as said plug body is moved axially and rotationally about the plug body axis, respectively, relative to the female connector;

a plate having a plurality of openings, each of the openings slidably receiving one of said blades therein;

means, coupled to said plate and said plug body, for slidably coupling said plate and said plug body between first and second positions; and locking means, coupled to and extending from said plate and receivable in at least one of the slots in the female connector once the blades are inserted into and translated in the slots, for resisting relative rotational translation of said plug body and the female connector, said locking means not being received in any one of said plurality of openings.

* * * * *